US005630438A

United States Patent [19]

Hoover et al.

[11] Patent Number: 5,630,438

[45] Date of Patent: May 20, 1997

[54] COLLAPSIBLE DOOR FOR A WAREWASHER

[75] Inventors: Richard Hoover, Troy; Ron Grise, Piqua; Gary Hoying, Sidney, all of Ohio

[73] Assignee: Premark FEG L.L.C., Wilmington, Del.

[21] Appl. No.: 632,556

[22] Filed: Apr. 15, 1996

Related U.S. Application Data

[60] Provisional application No. 60/003,592 Sep. 12, 1995.

[51] Int. Cl. [6] ..... A47L 15/42

[52] U.S. Cl. ..... 134/201; 49/125; 160/202

[58] Field of Search ..... 134/200, 201; 49/98, 103, 125; 160/197, 202, 211, 216

[56] References Cited

U.S. PATENT DOCUMENTS

| | | | |
|---|---|---|---|
| D. 199,196 | 9/1964 | Meeker et al. | D49/1 |
| D. 205,466 | 8/1966 | Meeker et al. | D49/1 |
| 2,063,746 | 12/1936 | Meeker . | |
| 2,073,521 | 3/1937 | Johnston et al. . | |
| 2,128,008 | 8/1938 | Meeker . | |
| 2,158,904 | 5/1939 | Meeker et al. . | |
| 2,217,705 | 10/1940 | Rataiczak et al. . | |
| 2,229,663 | 1/1941 | Meeker et al. . | |
| 2,707,961 | 10/1955 | Geiger et al. | 134/58 |
| 2,850,025 | 9/1958 | Bond | 134/200 X |
| 2,947,311 | 8/1960 | Fox et al. | 134/58 |
| 3,049,391 | 8/1962 | Meeker et al. . | |
| 3,125,105 | 3/1964 | Geiger | 134/58 |
| 3,328,062 | 6/1967 | Geiger et al. | 292/123 |
| 3,706,317 | 12/1972 | Fox et al. | 134/57 |
| 3,844,299 | 10/1974 | Athey et al. | 134/57 |
| 3,911,943 | 10/1975 | Athey et al. | 137/341 |
| 3,949,782 | 4/1976 | Athey et al. | 137/565 |
| 4,018,239 | 4/1977 | Caldwell et al. | 134/143 |
| 4,086,929 | 5/1978 | Focht | 134/56 |
| 4,086,938 | 5/1978 | Churley | 137/586 |
| 4,187,122 | 2/1980 | Query | 134/200 X |
| 5,257,638 | 11/1993 | Alvemarker | 134/200 |

FOREIGN PATENT DOCUMENTS 388630 3/1908 France .

*Primary Examiner*—Philip R. Coe

*Attorney, Agent, or Firm*—Thompson Hine & Flory LLP

[57] ABSTRACT

A warewashing machine has a washing chamber with an enlarged height to increase the chamber's capacity without increasing the warewashing machine's surface area, and has collapsible doors to facilitate larger openings to the enlarged washing chamber. The larger openings and enlarged capacity allow the warewashing machine to wash oversized wares. The collapsible doors allow the full access to the enlarged openings without significantly increasing the minimum height of the ceiling over the warewashing machine. The warewashing machine door also includes a pivoting handle with an downward curving arcuate section to allow the operator to easily reach the handle when the door is fully opened.

14 Claims, 10 Drawing Sheets

54
52
62
22
66
64
57
56
58
68
69

COLLAPSIBLE DOOR FOR A WAREWASHER

CROSS REFERENCE TO RELATED APPLICATION

This application claims priority from U.S. provisional patent application No. 60/003,592, filed Sept. 12, 1995.

BACKGROUND OF THE INVENTION

The present invention relates to warewashing machines and, particularly, to a novel slidable door for a warewashing machine which permits the warewashing machine to be used for washing conventional wares as well as oversized wares.

The size of these warewashers has become fairly standardized in the industry. With slight variations, the area of the base of the warewasher, 25 in.×25 in., has become a standard in the industry. Standard size warewashers can not accommodate oversized wares because the area of access to the washing chamber and the washing chamber, itself, are too small to allow oversized utensils to be fitted into the washing chamber. Typically, a standard warewasher has a washing chamber having an opening with dimensions of about 22 inches wide and about 17 inches high. The size constraints of the washing chamber and access areas to the washing chamber of standard warewashers do not permit items such as utensils, baking pans, cookie sheets and mixing bowls to be washed in the warewasher because these items are larger than the access doors and sometimes larger than the washing chamber itself. As a result of the size limitations in the design of standard warewashers, it is not unusual for a commercial kitchen to employ a separate washer for utensils such as baking pans, cookie sheets and mixing bowls.

Thus, need has developed in the art for a warewasher having a washing chamber and chamber doors sized for accepting oversized items such as utensils, baking pans, cookie sheets and large sized mixing bowls. This warewasher must have dimensions which fit into the same square foot floor area as a standard warewasher so that it can be used as a replacement for the standard warewasher without requiring that the kitchen, in which the warewasher is being used, be reconfigured.

A disadvantage with merely increasing the size of the door panel to allow for loading of such oversized wares is that, as the conventional door panels are conventionally slid upward to provide access to a washing chamber, increasing the size of these panels would, in some situations, be limited by the height of the kitchen ceiling.

SUMMARY OF THE INVENTION

This present invention is directed to a warewasher which can be used to wash not only conventional wares such as plates, glasses and tableware but also oversized wares such as utensils, baking pans, cookie sheets and large sized mixing bowls. The doors of this invention are particularly suited for use with a warewasher having a larger than standard size washing chamber, and are designed to allow this larger capacity warewasher to occupy substantially the same kitchen space as a conventional warewasher. The doors of this invention can be used as either inspection doors or as access doors for such a warewasher.

The warewasher doors of this invention comprises two slidable panels, a lower panel and an upper panel. Both panels are slidably mounted in vertical tracks on vertical sides of a rectangular opening into the washing chamber of the warewasher. The lower panel is mounted so that it slides in front of the upper panel. A first flange extends from the upper panel and is adapted to rest on the top of the warewasher when the door is closed, to prevent water from flowing out of the warewasher and to also serve as a downward motion stop for the upper panel. A second flange extends from the upper panel toward the lower panel, and a third flange extends from the lower panel to engage and overlap the second flange of the upper panel to provide a seal which prevents water from flowing between the two panels when the door is closed.

The lower panel also includes a bracket mounted on its inside which engages the lower surface of the upper panel when the lower panel is raised to a predetermined height. This engagement allows the lower panel to lift the upper panel creating an additional area of clearance equal in size to the area of the upper panel to allow insertion of oversized wares and utensils into the washing chamber.

The present invention also includes a pivoted handle designed to facilitate easy opening of the warewasher doors. The end portion of the handle has a downward curving arcuate shape which allows it to be easily grasped when the door is either in the open or closed position. The handle includes three sections: an arcuate section which leads into a straight section which terminates in a transverse section. The handle pivots about a pin mounted on the washing chamber of the warewasher. The door is opened by grasping the arcuate section and lifting the arcuate section of the handle toward the top of the machine. This motion causes the handle to pivot about the pivot pin to cause the door to open. When the door is fully opened, the operator can easily grasp the handle by the arcuate section which curves down well within reach of the operator, allowing the operator to easily pull the door back to a closed position.

Other objects and advantages of the present invention will be apparent from the following description, the accompanying drawings and the appended claims.

DETAILED DESCRIPTION OF THE INVENTION

Currently in the art, two types of warewashers are used, a two door warewasher and a three door warewasher. The two door warewasher is designed to be placed in a corner for use and has doors on two adjacent sides. With this type of warewasher, the wares are loaded into the warewasher through one door and removed through the adjacent door. The three door warewasher is designed for use when placed against a wall so that the back side of the warewasher faces the wall. This model has doors on three adjacent sides. In this model, the dishes are loaded into a door on one side of the warewasher and removed from a door on the opposite side of the warewasher. The third door, on the front of the warewasher, can be opened to inspect the dishes and the washing chamber, or to load or remove items to or from the washing chamber.

Figure 1:
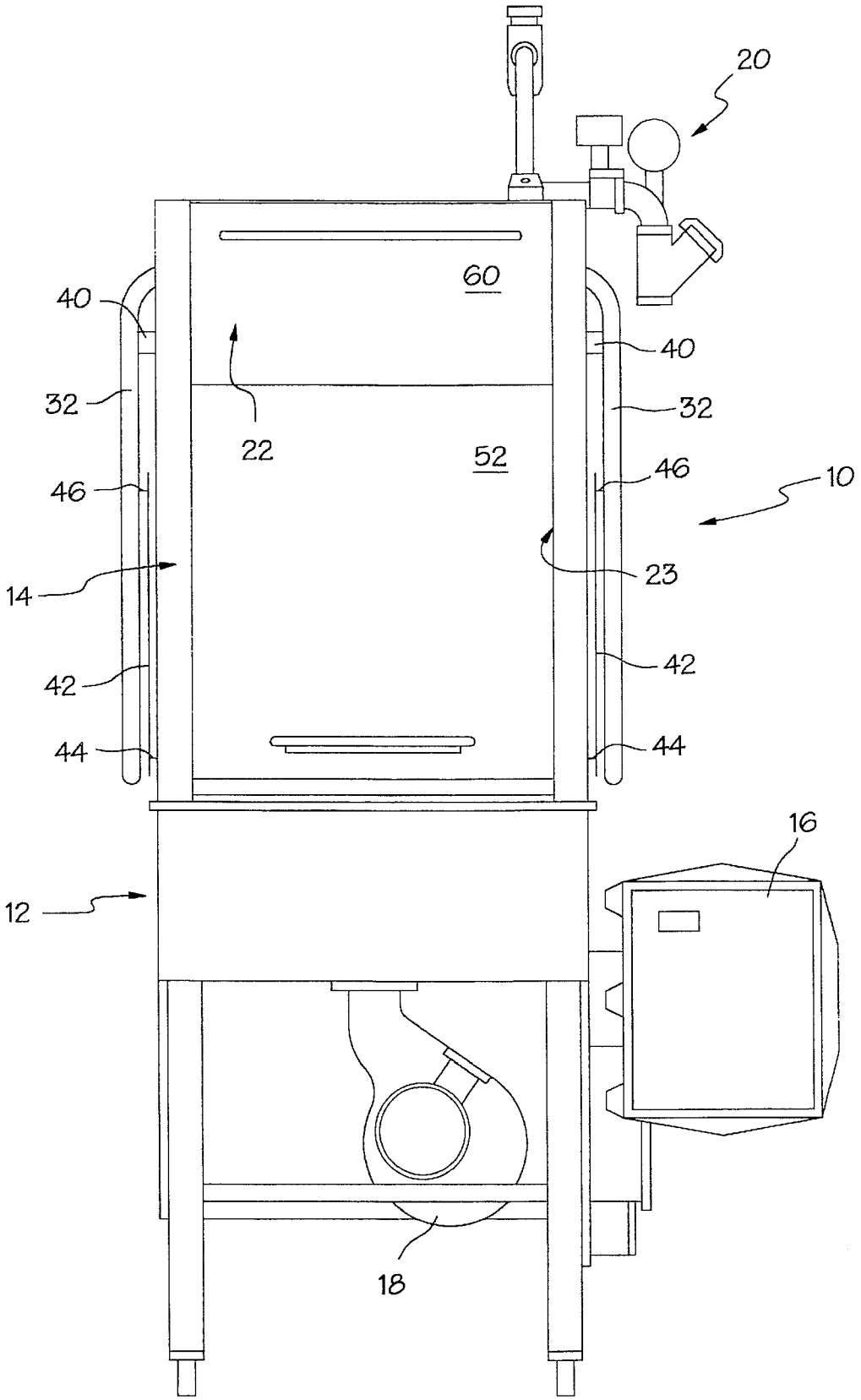
FIG. 1 presents a front view of a warewasher incorporating doors and door handles of the present invention.

FIG. 1 presents a front view of a three-door warewasher 10 which generally comprises a base 12, a washing chamber 14, a control means 16, a motor and pump assembly 18 and plumbing 20. The washing chamber 14 and the control means 16 are mounted on the base 12. The control means 16 controls the operations of the warewasher 10. The motor and pump assembly 18 is mounted on the base 12 beneath the washing chamber 14. The pump circulates water in the washing chamber 14 and the motor drives the pump. Plumbing 20 is mounted on the rear and top of the washing chamber 14 and extends from the top of the washing chamber 14. A front, "inspection" door 22 of the present invention, is slidably mounted on the front of washing chamber 14 to provide access to a rectangular opening 23 on the front of the washing chamber; and two side doors 30 (See FIG. 2) of the present invention are slidably mounted, one on each side, of the washing chamber 14, to provide access to rectangular openings 31 on the left and right sides of the washing chamber. A front handle 24, for opening and closing the front door 22, is mounted on the outside of the front door 22, and a pivoting side handle 32 for opening the side doors 30 is mounted to the warewasher and to the side doors as will be described in detail below.

Figure 2:
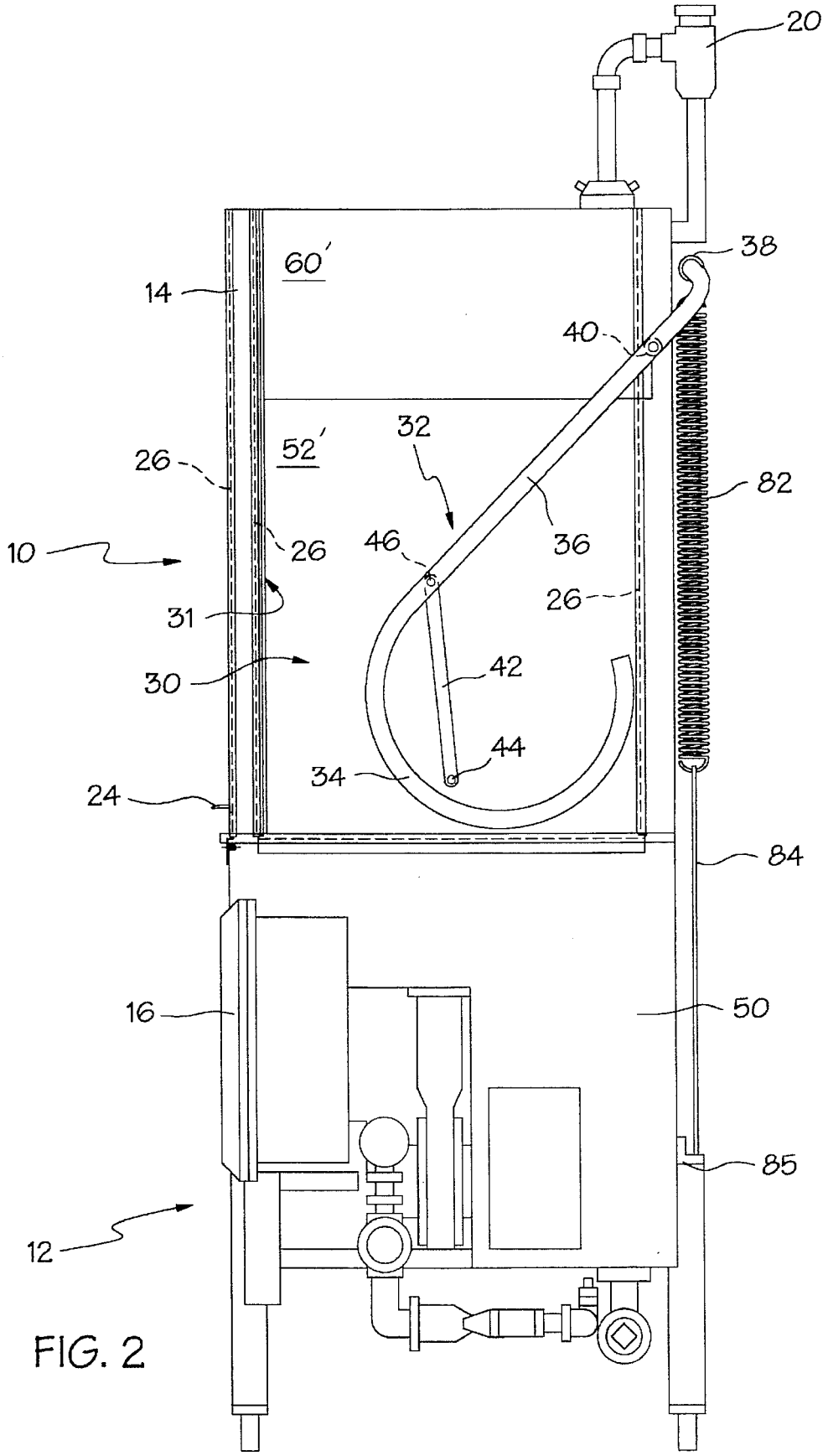
FIG. 2 presents a side view of a warewasher incorporating doors and door handles of the present invention.

As shown in FIG. 2, the side doors 30 are slidably mounted on each side of washing chamber 14. This is such that dirty wares can be fed into one side of the warewasher, through one side door 30, and such that the cleaned wares can be taken from the opposite side of the warewasher, through the other side door 30. The pivoting handle 32, for opening and closing the side doors 30, is mounted on the warewasher and comprises a pair of arcuate sections 34 (one shown), a pair of straight sections 36 (one shown) and a transverse section 38. As is described in detail below, the handle 32 is pivotally mounted on washing chamber 14 by a pair of pivot mechanisms 40 (see also FIG. 1), and is coupled to the side doors 30 by a pair of flat link bars 42 (one shown). As can also be seen in FIG. 2, a water tank 50 is located beneath the washing chamber 14.

Figure 3:
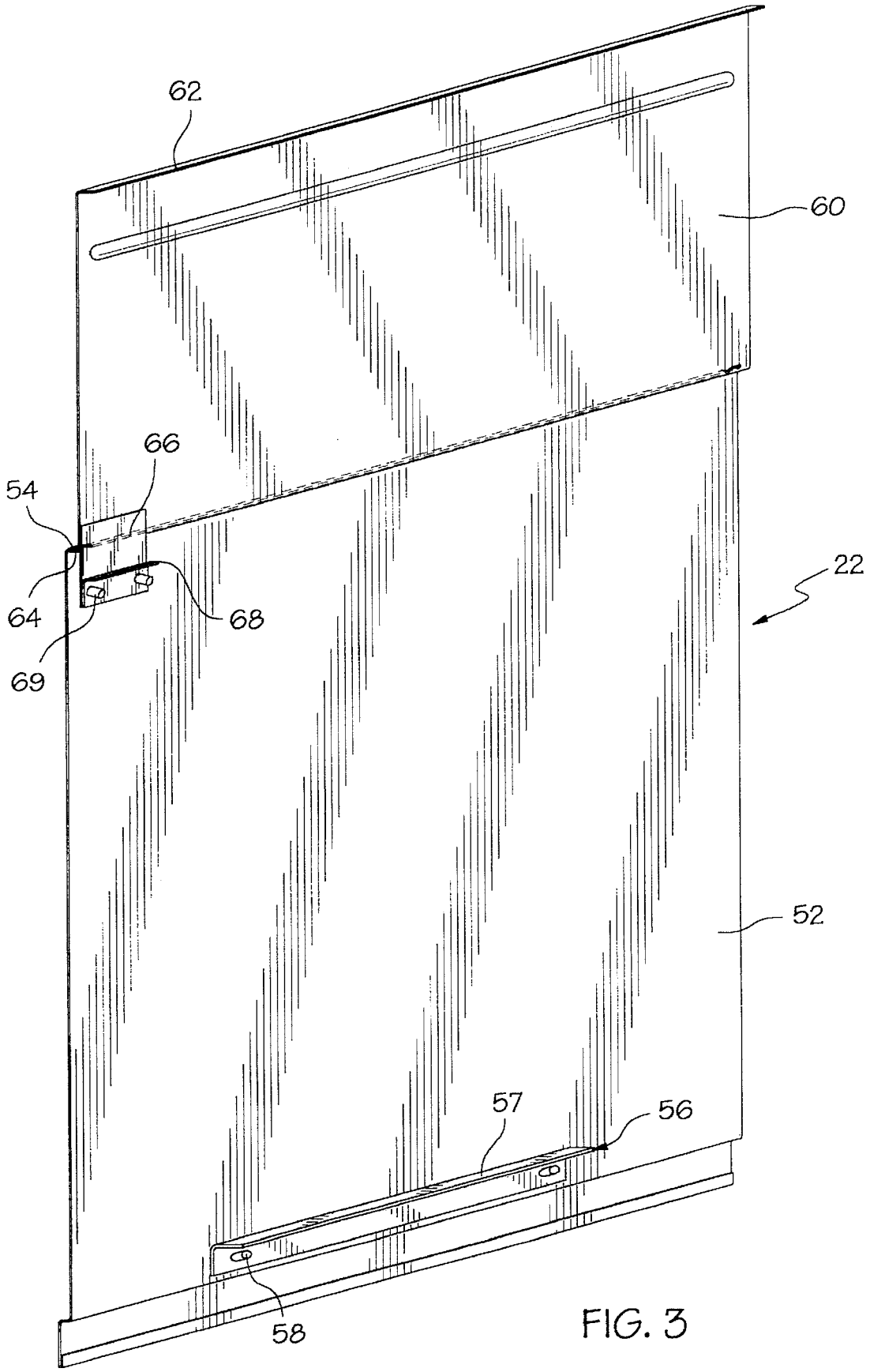
FIG. 3 presents a perspective view of a warewasher door of the present invention in a closed position shown from the inside of the warewasher.
Figure 4:
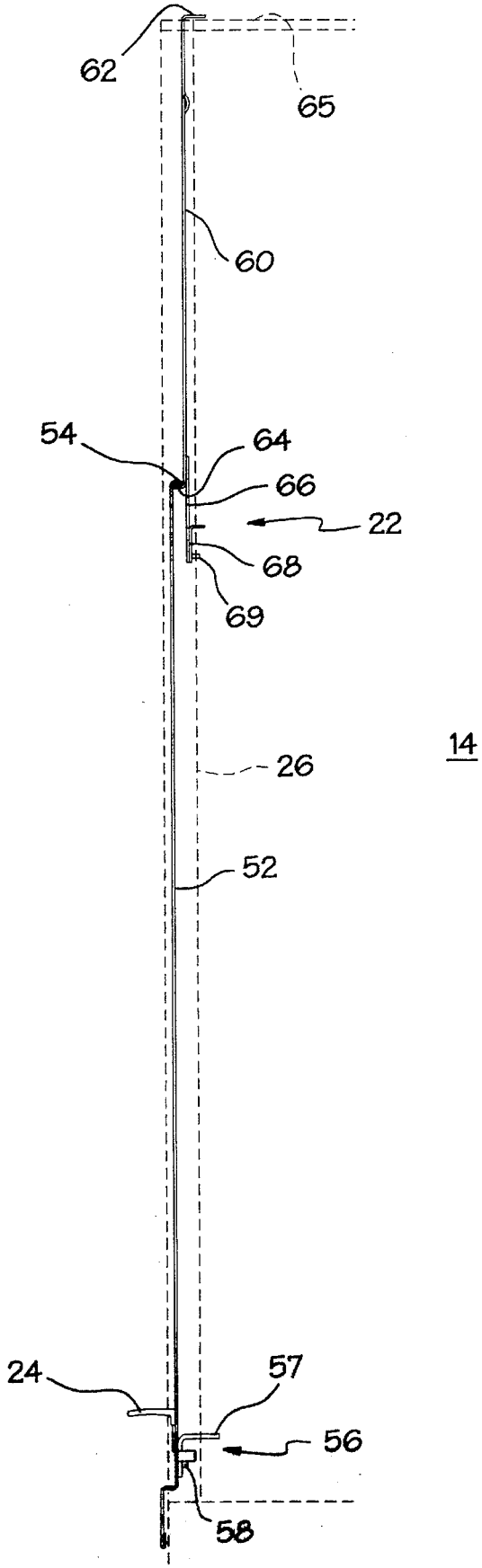
FIG. 4 presents an end view of the warewasher door in the closed position.

FIG. 3 presents a perspective view of the front door 22 of this invention in the closed position as seen from the inside of the washing chamber 14; and FIG. 4 presents an end view of the front door 22 in the closed position. As shown in FIGS. 3 and 4, the front door 22 comprises a lower panel 52, and an upper panel 60 positioned above the lower panel 52. The lower and upper panels 52, 60 are slidably mounted in vertical tracks 26 fastened to the vertical sides of the rectangular opening 23. The lower panel 52 is mounted in front of the upper panel 60 in the tracks 26.

A flange 54 extends inwardly from the upper edge of the lower panel 52 and is adapted to slide along the outer surface upper panel 60. An inwardly extending flange 62 and an outwardly extending flange 64 extend from the upper and lower horizontal edges of upper panel 60, respectively. As shown in FIG. 4, in the door's closed position, the flange 62 rests over the top 65 of the washing chamber 14 to prevent water overflow from the washing chamber 14; and the flange 54 on the lower panel 52 engages and overlies the flange 64 to prevent water from escaping from between the lower and upper panels 52, 60. The flange 64 is adapted to slide along the inner surface of the lower panel 52 as the front door 22 is being opened or closed.

As can be seen in FIG. 3, a door stop 56, having an inwardly extending shelf portion 57, is mounted on the inside of lower panel 52 by fasteners 58; a bracket 66 is mounted on the inside surface of the upper panel 60; and an inwardly extending door stop 68 is mounted to the bracket 66 by fasteners 69.

Figure 5:
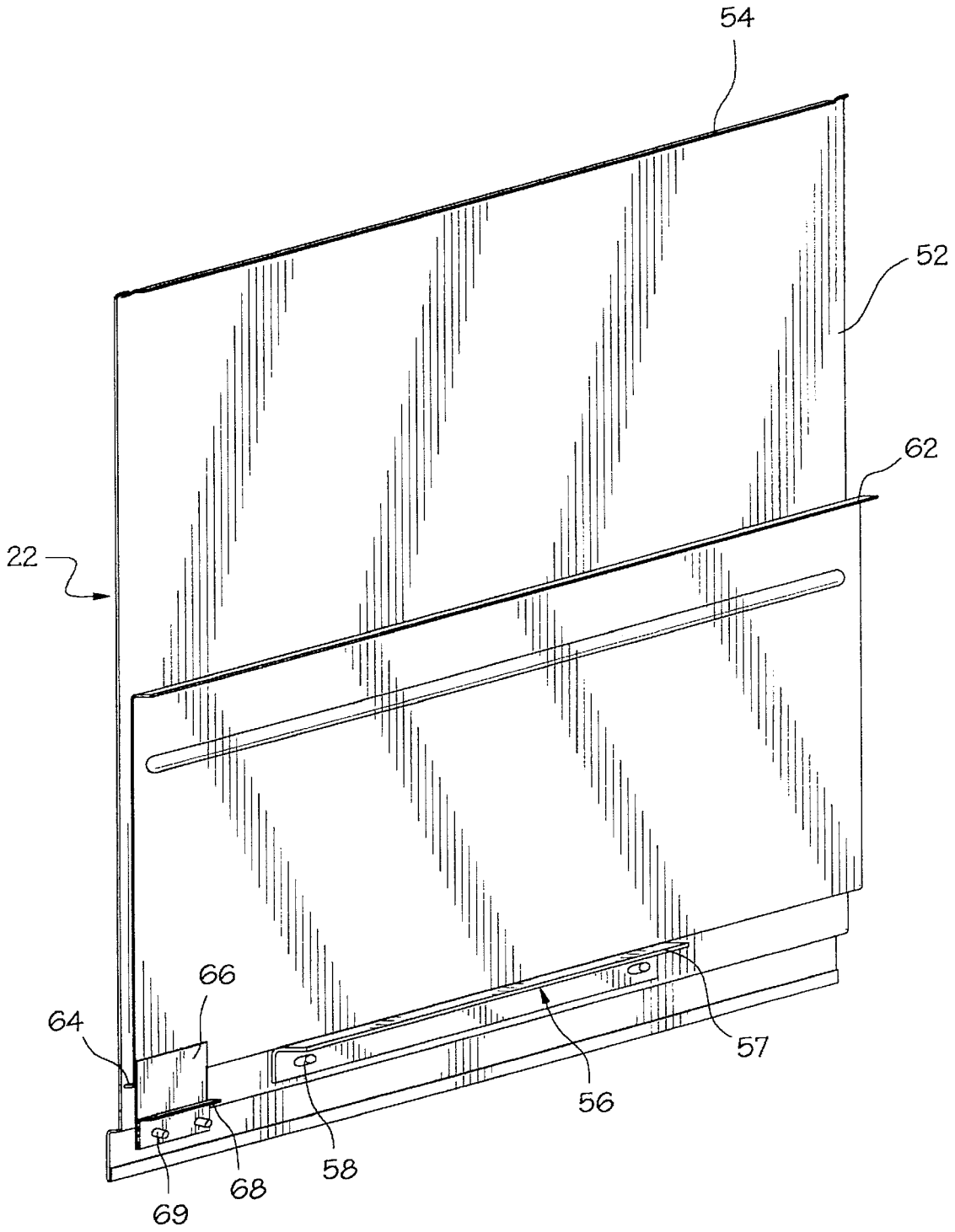
FIG. 5 presents a perspective view of the warewasher door in an open position from the inside of the warewasher.
Figure 6:
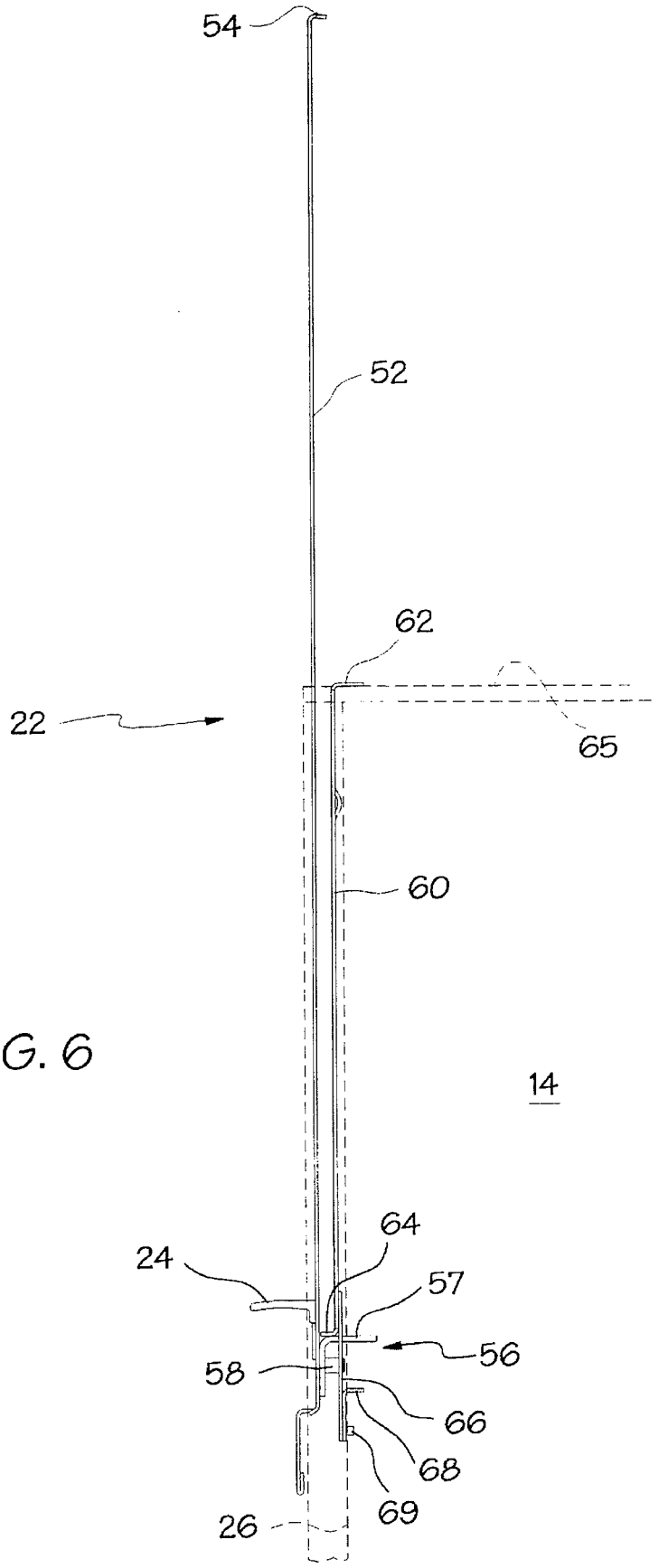
FIG. 6 presents an end view of the warewasher door in an intermediate open position.

To open the front door 22, an operator lifts upwardly on the handle 24, mounted on the outside of the lower panel 52, to cause the lower panel 52 to slide upwardly in the tracks 26. Referring to FIGS. 5 and 6, the lower panel 52 is lifted until the shelf portion 57 of door stop 56 contacts the bottom side of the flange 64. When the bracket 56 contacts the bottom side of the flange 64, the front door 22 is opened in an intermediate open position, which provides a first area of access to washing chamber 14. This area of access is typically equal in size to the area of access of conventional warewashers. At this point, the upper panel 60 is still stationary and the flange 62 of the upper panel remains at rest over the top 65 of the washing chamber 14.

Figure 7:
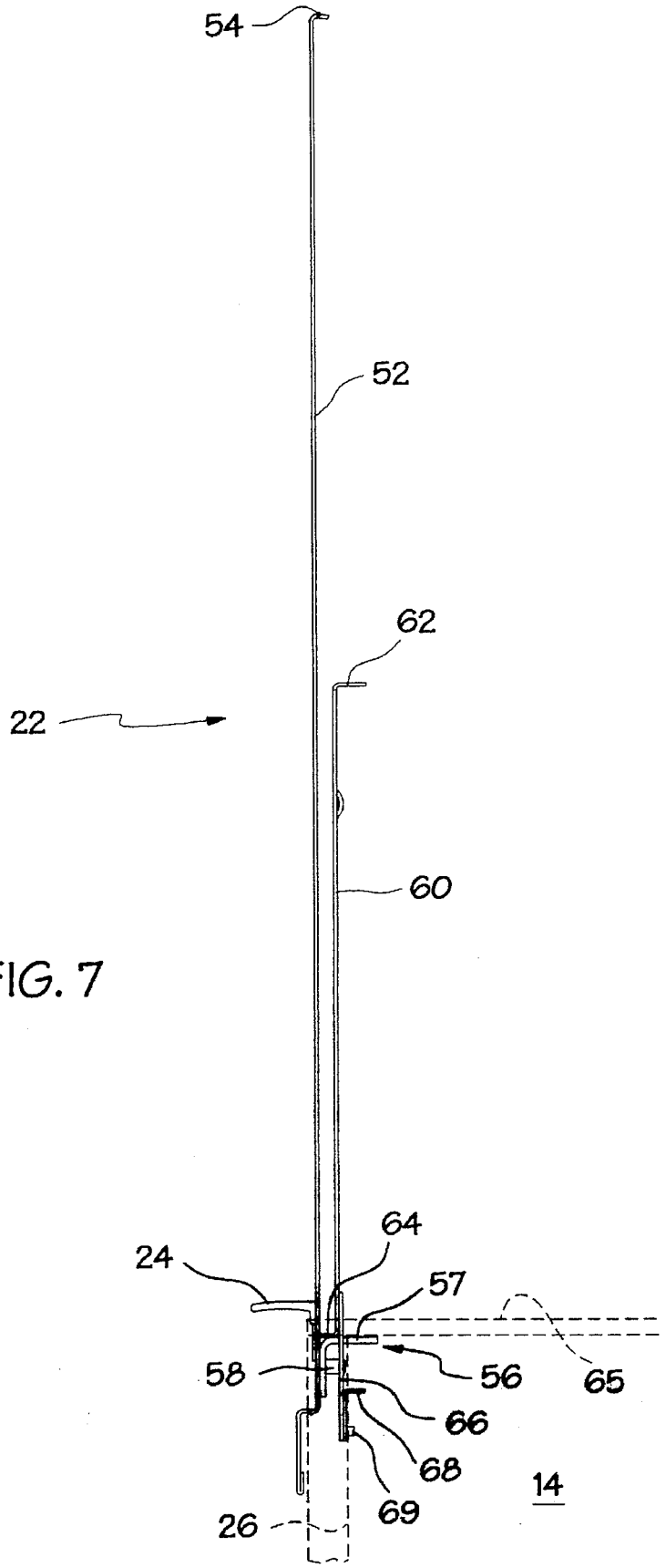
FIG. 7 present an end view of the warewasher door in a maximum advanced open position.

As shown in FIG. 7, the front door 22 can be opened further to an advanced open position which provides a second area of access to washing chamber 14, larger than the first area of access. To accomplish this, the operator continues to lift upwardly on the handle 24 such that the door stop 56, engaged with the flange 64, translates upward force to the upper panel 60, causing both the upper panel 60 and the lower panel 52 to slide upwardly in the tracks 26. When the front door 22 is in an advanced open position, the door stop 56 is engaged with the flange 64 of the upper panel 60 to maintain the upper panel 60 in this advanced open position.

Furthermore, the shelf portion 57 of door stop 56 extends inwardly beyond the flange 64 such that it can catch onto the upper edge of washing chamber 14 when the door stop 56 is lifted to the height of the edge of the washing chamber. This contact causes the upward motion of the upper and lower panels 60, 52 to stop and, at this point, the front door 22 is at its maximum advanced open position.

When the front door 22 is in an advanced open position, the bracket 66 and door stop 68 are provided on the upper panel 60 to prevent the removal of the upper panel 60 from the warewasher 10. The door stop 68 on the bracket 66 is adapted to engage the top 65 of the washing chamber 14 of the warewasher 10, thus preventing the upper panel 60 from being slid above the warewasher 10, thereby securing the upper panel within the tracks 26. If upper panel 60 were removed and the lower panel 52 of door 22 were to be subsequently shut, the warewasher 10 would spray water over the area in which the warewasher 10 is used. It should also be apparent that since the upper panel 60 is secured in the tracks 26, then lower panel 52 is also prevented from being slid above the warewasher due to the engagement of the door stop 56 on the flange 64 with the bottom of the upper panel 60.

The addition of the upper panel 60 to the front door 22 creates an area of access to the washing chamber 14, which, when the front door 22 is opened to an advanced position, can exceed the area of access to the washing chambers of a prior art warewasher by the height of the upper panel 60. Preferably, the washing chamber 14 has a height which is about 11 inches higher than the height of a conventional warewasher. This increased height produces a correspondingly increased area of access to the washing chamber 14, which allows loading of oversized items, such as utensils, baking pans, cookie sheets and large sized mixing bowls into the washing chamber 14. By extending the height of the washing chamber 14 upward by 11 inches, the volume of the washing chamber 14 is effectively increased without producing a corresponding increase in the floor space area that base 12 of warewasher 10 occupies; and furthermore, because the upper and lower panels 60, 52 collapse together as the front door 22 is being opened, the height of the ceiling does not restrict opening the front door 22 to its advanced open position.

To close the front door 22, downward force is applied to handle 24; or alternatively, any upward force is removed from the handle to allow the door to close by gravitational means. From an advanced open position, as the lower panel 52 slides back down, the upper panel 60, which rests on the door stop 56, also slides down with the lower panel until the flange 62 contacts and rests upon the top 65 of the washing chamber 14. Once the flange 62 rests upon the top 65 of washing chamber 14, the downward motion of upper panel 60 is stopped, and the door 22 has returned to the intermediate open position.

From the intermediate open position, the operator continues to slide the lower panel 52 downward. When the flange 54 on the lower panel 52 engages the flange 64 on the upper panel 60, the closure of the front door 22 is complete.

As shown in FIG. 2, the side doors 30 are also preferably constructed and operate substantially identical to the front door 22, having collapsible lower and upper panels 52', 60' which allow for intermediate and advanced opening capabilities. Furthermore, in a preferred embodiment, the warewasher 10 includes the pivoting side handle 32 designed to facilitate easy opening and closing of the side doors 30. Therefore, other than for the operation of the pivoting handle 32 as will be given below, the above description of the structure and operation of the front door 22 will suffice to adequately describe the structure and operation of the side doors 30.

Figure 8:
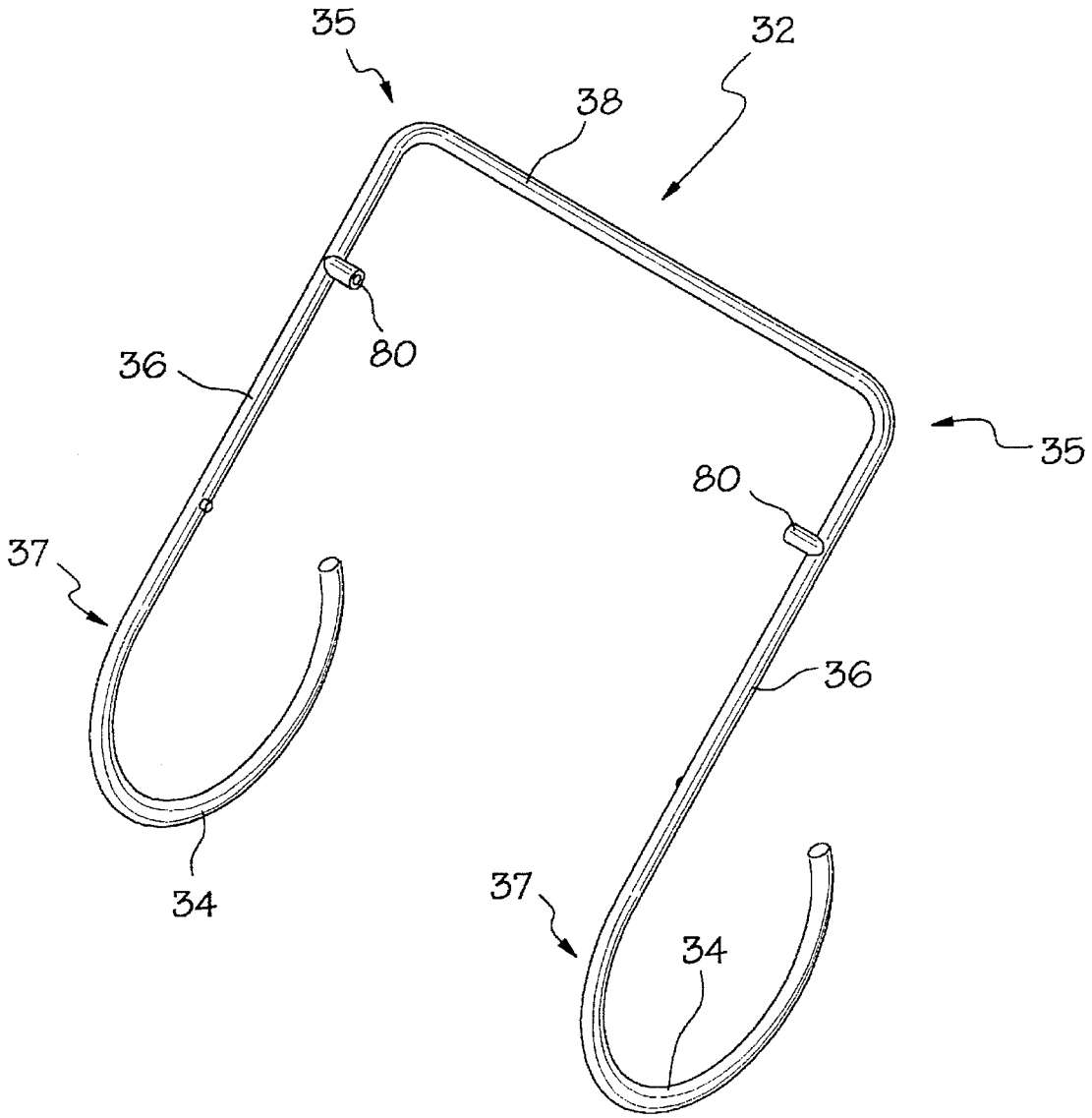
FIG. 8 presents a perspective view of a pivotal handle for use with the present invention.

As shown in FIG. 8, the handle 32 includes a pair of arcuate sections 34, a pair of straight sections 36 and a transverse section 38. Transverse section 38 bridges between aftward ends 35 of parallel straight sections 36, such that the handle is substantially u-shaped; and the forward ends 37 of the straight sections 36 tangentially adjoin the downward curving arcuate sections 34. An inwardly extending boss 80 is formed on each straight section 36 of the handle 32, for pivotally mounting the handle onto the washing chamber 14 of the warewashing machine 10 by means of a pivot pin mechanism 40, which engages with the bosses 80 as is described in detail below.

Figure 10:
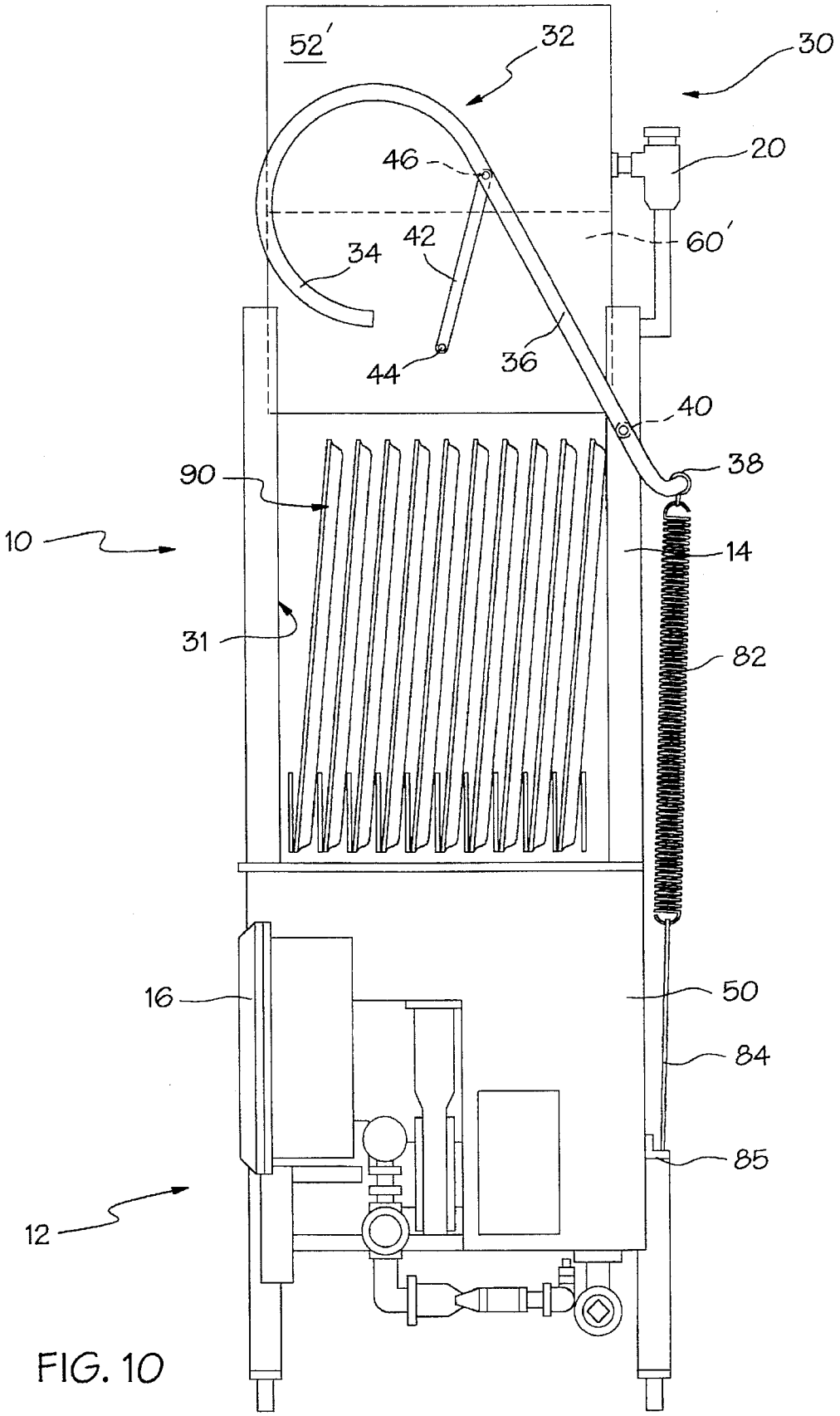
FIG. 10 presents a side view of a warewasher incorporating doors and door handles of the present invention in an advanced open position.

As shown in FIGS. 2 and 10, the transverse section 38 of the pivoting handle 32 extends across the rear of washing chamber 14 and adjoins the parallel straight section 36 on the opposite sides of washing chamber 14. The handle 32 is coupled to the side doors 30 by means of a pair of flat link bars 42. Each link bar 42 is coupled to the side doors 30 by a pivotal coupling 44 at a first end of the link bar, and each link bar is also coupled to the handle 32 by a pivotal coupling 46 at an opposite end of the link bar. Preferably, the pivotal couplings 46 are located along the handle 32 approximately at the forward ends 37 of the straight sections 36; and preferably, the pivotal couplings 44 are located near the bottom-center of the lower door panels 52'. The link bars 42 and pivotal couplings 44, 46 allow the handle 32 to be coupled to the doors 30 while allowing to arcuate sections 34 of the handles to both pivot and translate with respect to the doors as the doors are being vertically raised or lowered.

As will be apparent to one of ordinary skill in the art, there are many conventional means available for providing an adequate pivoting and translating coupling for the handle as described above. For instance, the handle can be pivotally attached to a coupling which is, in turn, slidably mounted in a groove in the lower panel 52' of the door.

A conventional counterbalance spring 82 is coupled at one end to the transverse portion 38 of the handle 32, and is coupled at its other end to a rod 84 which is secured to a flange 85 extending across the rear of base 12 of warewasher 10.

Figure 9:
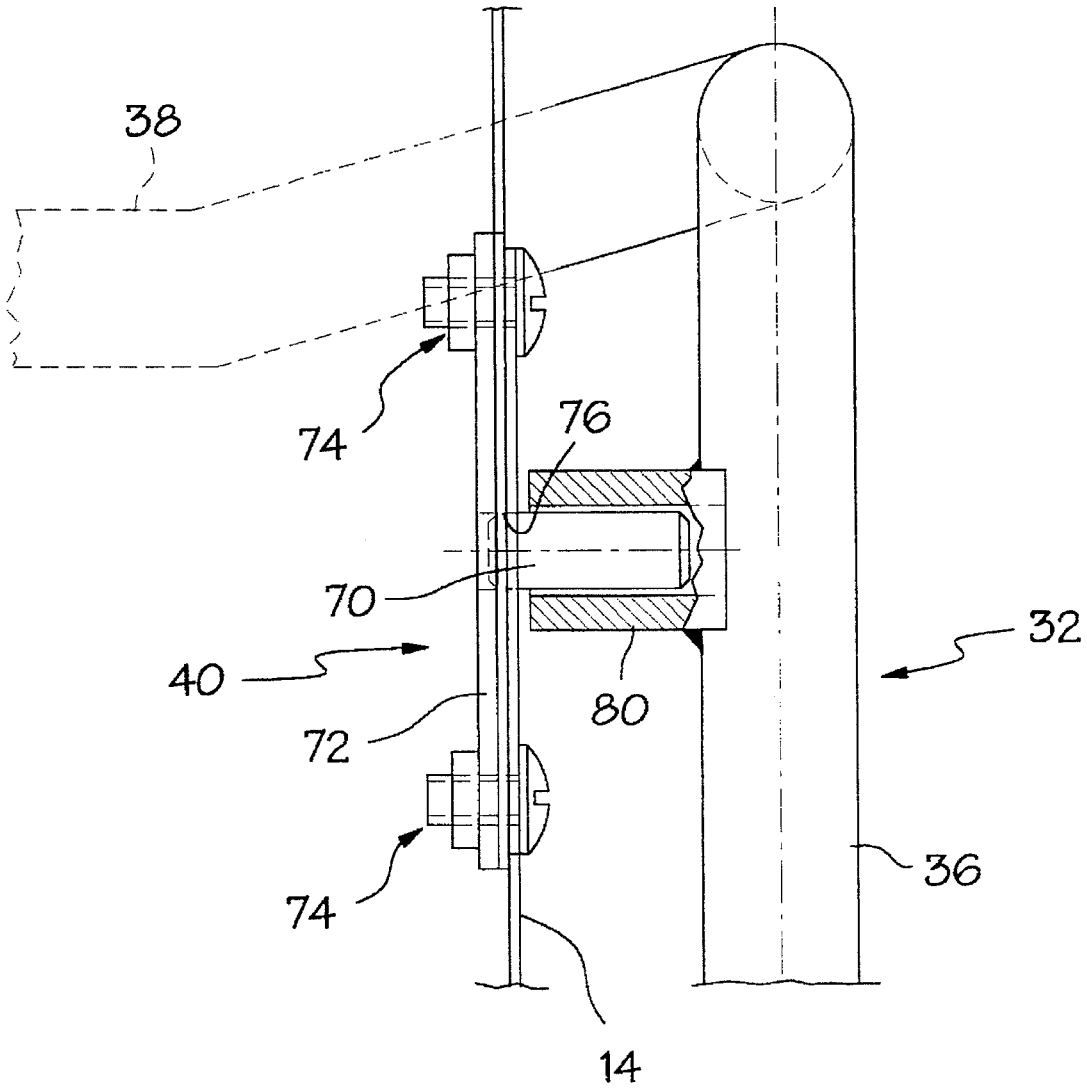
FIG. 9 presents a cross sectional view of a mounting for the pivotal handle on the washing chamber.

As shown in FIG. 9, the pivot pin mechanism 40 comprises a pin 70 and a boss 80. the pin 70 is welded on a plate 72 which is attached to the washing chamber 14 by means of fasteners 74. The pin 70 extends through an aperture 76 in the washing chamber 14. The boss 80 is welded onto the straight portion 36 of the handle 32. The pin 70 fits into the boss 80 to pivotally mount the handle 32 to the washing chamber 14.

To open the side doors 30 with the pivoting handle 32, the operator grasps the handle 32 by one of the arcuate sections 34 and lifts upwardly such that handle 32 rotates about the pivot pin mechanisms 40 (clockwise in FIG. 2) and, in turn, simultaneously lifts both side doors 30 by means of the link rods 42. The counterbalance spring 82 assists the operator in lifting handle 32 against gravitational forces, and acts to maintain the doors 30 in an open position, against gravitational forces, once they have been opened.

As shown in FIG. 10, as the side doors 30 are opened to an advanced open position, exposing oversized articles 90, the positions of the pivotal couplings 44, 46, and the downward curve and diameter of the arcuate section 34, ensures that a portion of the arcuate section of the handle 32 is positioned near the front and top of warewashing chamber 14 so that the handle 32 can be easily reached and grasped by the operator. It has been found that an arcuate section 34 having a radius ranging from approximately four inches to eight inches (4"–8") provides the preferred positioning and reach capabilities for the handle 32 in all opened and closed positions of the door; while an arcuate section 34 having a radius of approximately seven inches (7") provides the optimum positioning and reach capabilities for the handle 32.

The operator closes the doors 30 by grasping the handle 32, in or near the arcuate section 34, and by pulling it down to overcome the force of the counterbalance spring 82. This causes the handle 32 to rotate about the pivot pin mechanisms 40 (counter-clockwise in FIG. 2) and, in turn, simultaneously causes the link rods 42 to slide down both side doors 30.

As should be apparent to one of ordinary skill in the art, it is within the scope of the present invention to provide a pivoting handle, similar to pivoting handle 32, for a single warewasher door. Such an alternative handle would include an arcuate section and a straight section similar to that of the pivoting handle 32; would be pivotally coupled to the warewasher near the aft end of the straight section similar to the pivoting handle 32; and would be translationally and pivotally coupled to the warewasher door via a link bar similar to that of the pivoting handle 32.

One skilled in the art will also appreciate that the collapsible doors of this invention can be used on both the two door and the three door warewasher. The collapsible doors of this invention may also be used on a single door warewasher with little or no modification. One skilled in the art will also appreciate that the collapsible warewasher doors of this invention can be used either as inspection doors or access doors to the washing chamber. Whether used as an inspection door or as an access door, its function and operation are be the same as they are described above.

Having described the invention in detail, it will be apparent that numerous variations and modifications are possible without departing from the spirit and scope of the invention as described and claimed herein.

What is claimed is:

1. A warewashing machine comprising:

a base;

a washing chamber supported on the base, the washing chamber having at least one generally rectangular opening with two vertical sides on a first side of the washing chamber;

vertical tracks mounted on each vertical side of the opening; and a door for providing access to the opening, the door including, a lower panel, having an upper end, a lower end, an inner surface and an outer surface, slidably mounted in the vertical tracks;

a handle mounted to the outer surface of the lower panel;

an upper panel slidably mounted in the vertical tracks inside of the lower panel, having an upper end, a lower end, a lower surface, an inner surface, and a first flange extending inwardly from the upper end of the upper panel for engaging with a top surface of the washing chamber and for restricting the upper panel from sliding below the top surface of the washing chamber; and a door stop mounted on the inner surface of the lower panel, near the lower end of the lower panel, for engaging with the lower surface of the upper panel;

wherein the door can be opened to an intermediate position by raising the lower panel such that the door stop contacts the lower surface of the upper panel, providing a first area of access to the washing chamber; and wherein the door can be opened to an advanced position by raising the lower panel further such that the door stop, engaged with the lower surface of the upper panel, causes the upper panel to be simultaneously raised, providing a second area of access to the washing chamber which is larger than the first area of access.

2. The warewashing machine of claim 1, wherein the door further includes:

a second flange extending inwardly from the upper end of the lower panel; and a third flange extending outwardly from the lower end of the upper panel;

the second flange being adapted to engage the third flange and to provide a seal between the upper and lower panels when the door is closed.

3. The warewashing machine of claim 2, wherein the first flange is adapted to prevent water from escaping from the washing chamber when the door is closed.

4. The warewashing machine of claim 3, wherein the door further includes a second door stop coupled to the inner surface of the upper panel to prevent the upper panel from being removed from the warewashing machine.

5. The warewashing machine of claim 1 wherein the handle includes:

a straight section having an aft end and a forward end; and a downward curving arcuate section, tangentially extending from the forward end of the straight section;

the handle being pivotally coupled to the warewasher, by a first coupling, near the aft end of the straight section; and the handle being pivotally and translationally coupled, by a second coupling, to the door near the forward end of the straight section.

6. The warewashing machine of claim 5, further including a counterbalance spring coupled between the handle and the warewasher to assist in pivoting the handle about the first coupling, and in turn, opening the door.

7. The warewashing machine of claim 6, wherein the arcuate section has a radius of approximately seven inches.

8. The warewashing machine of claim 5, wherein the second coupling includes a link bar pivotally coupled to the handle near the forward end of the straight section and pivotally coupled to the door near the bottom center of the lower panel.

9. The warewashing machine of claim 5, wherein the arcuate section has a radius of approximately four to eight inches.

10. The warewashing machine of claim 1, wherein the door is an inspection door or an access door for a warewashing machine.

11. A warewashing machine comprising:

a base;

a washing chamber supported on the base, the washing chamber having a first and second one generally rectangular openings on opposite sides of the washing chamber, each opening having two vertical sides;

vertical tracks mounted on each vertical side of the first and second openings; and first and second doors for providing access to the first and second openings, each door including, a lower panel, having an upper end, a lower end, an inner surface and an outer surface, slidably mounted in the vertical tracks;

a handle mounted to the outer surface of the lower panel;

an upper panel slidably mounted in the vertical tracks inside of the lower panel, having an upper end, a lower end, a lower surface, an inner surface, and a first flange extending inwardly from the upper end of the upper panel for engaging with a top surface of the washing chamber and for restricting the upper panel from sliding below the top surface of the washing chamber; and a door stop mounted on the inner surface of the lower panel, near the lower end of the lower panel, for engaging with the lower surface of the upper panel;

wherein each door can be opened to an intermediate position by raising the lower panel such that the door stop contacts the lower surface of the upper panel, providing a first area of access to the washing chamber; and wherein each door can be opened to an advanced position by raising the lower panel further such that the door stop, engaged with the lower surface of the upper panel, causes the upper panel to be simultaneously raised, providing a second area of access to the washing chamber which is larger than the first area of access.

12. The warewashing machine of claim 11 wherein each handle includes:

a straight section having an aft end and a forward end; and a downward curving arcuate section, tangentially extending from the forward end of the straight section;

each handle being pivotally coupled to the warewasher, by a first coupling, near the aft end of the straight section; and each handle being pivotally and translationally coupled, by a second coupling, to the door near the forward end of the straight section;

each second coupling including a link bar pivotally coupled to its corresponding handle near the forward end of the straight section and pivotally coupled to its corresponding door near the bottom center of the lower panel.

13. The warewashing machine of claim 12, further comprising:

a transverse bar, positioned behind the washing chamber and coupled to the aft ends of the straight sections of the handles of the first and second doors;

wherein the first and second doors will open and close simultaneously.

14. The warewashing machine of claim 13, further comprising a counterbalance spring coupled between the transverse bar and the warewasher to assist in pivoting the handles about the first couplings, and in turn, opening the first and second doors.

* * * * *